US006584291B1

(12) United States Patent
Yamamoto

(10) Patent No.: US 6,584,291 B1
(45) Date of Patent: Jun. 24, 2003

(54) IMAGE FORMING APPARATUS FOR CALCULATING A PRINTABLE NUMBER OF SHEETS AND A CARTRIDGE DETACHABLY MOUNTABLE TO THE APPARATUS COMPRISING A MEMORY FOR STORING DATA REPRESENTING A PRESENT AMOUNT OF DEVELOPER

(75) Inventor: Shinya Yamamoto, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/656,475

(22) Filed: Sep. 6, 2000

(30) Foreign Application Priority Data

Sep. 8, 1999 (JP) ..... 11-254907

(51) Int. Cl.[7] ..... G03G 15/08; G03G 15/00
(52) U.S. Cl. ..... 399/27; 399/25
(58) Field of Search ..... 399/24, 25, 27, 399/30, 53, 61

(56) References Cited

U.S. PATENT DOCUMENTS 4,961,088 A 10/1990 Gilliland et al.
5,105,219 A * 4/1992 Yoshikado ..... 399/27
5,160,966 A * 11/1992 Shiina et al. ..... 399/27
5,459,556 A 10/1995 Acquaviva et al.
5,794,094 A * 8/1998 Boockholdt et al. ..... 399/27
5,802,420 A * 9/1998 Garr et al. ..... 399/27
5,835,817 A 11/1998 Bullock et al.
5,923,917 A * 7/1999 Sakurai et al. ..... 399/27

FOREIGN PATENT DOCUMENTS

EP 0 840 182 5/1998

* cited by examiner

*Primary Examiner*—Sandra Brase
(74) *Attorney, Agent, or Firm*—Fitzpatrick, Cella, Harper & Scinto

(57) ABSTRACT

An image forming apparatus is provided, which comprises a developer container for containing developer, a developer amount detector for detecting an amount of the developer contained in the developer container, a pixel number counter for counting the number of pixels required for forming an image, a sheet number counter for counting the number of sheets of a recording material on which an image is formed and a calculator for calculating the printable number of sheets from the present onward using the developer amount detected by the detector, the number of pixels counted by the pixel number counter and the number of sheets counted by the sheet number counter.

28 Claims, 12 Drawing Sheets

IMAGE FORMING APPARATUS FOR CALCULATING A PRINTABLE NUMBER OF SHEETS AND A CARTRIDGE DETACHABLY MOUNTABLE TO THE APPARATUS COMPRISING A MEMORY FOR STORING DATA REPRESENTING A PRESENT AMOUNT OF DEVELOPER

BACKGROUND OF THE INVENTION

1. Field of the Invention

The present invention relates to, for example, an image forming apparatus for forming an electrostatic latent image on an image bearing body by the electrophotographic method and visualizes the electrostatic latent image with developer stored in a developing apparatus, and more particularly to an image forming apparatus having a developer amount detecting device provided with residual developer amount detecting means capable of serially detecting the residual amount of developer stored in a developer container as well as a cartridge that is insertable in the image forming apparatus main body, that is, a process cartridge, and a developing apparatus constituted as a cartridge.

Here, for example, an image forming apparatus includes an electrophotographic copying machine, an electrophotographic printer (for example, an LED printer, a laser beam printer and the like), an electrophotographic facsimile apparatus and so on.

In addition, here, a process cartridge also refers to a cartridge which is integrally composed of at least one of charging means, developing means and cleaning means, and an electrophotosensitive body, and is made detachably attachable to an electrophotographic image forming apparatus main body, or it refers to a cartridge that is integrally composed of at least developing means and an electrophotosensitive body, and is made detachably attachable to an electrophotographic image forming apparatus main body.

2. Related Background Art

In a conventional image forming apparatus using an electrophotographic image forming process, the process cartridge method is adopted, in which the cartridge is integrally composed of an electrophotographic sensitive body and process means which processes the electrophotosensitive body and makes the cartridge detachably attachable to an electrophotographic image forming apparatus main body. In accordance with the process cartridge method, since the maintenance of the apparatus can be conducted by a user in person and not by a serviceman, the operability is considerably improved. Hence, the process cartridge method is widely used in electrophotographic image forming apparatuses.

In an electrophotographic image forming apparatus with a process cartridge method, although an image can be formed again by replacing a cartridge when the developer is exhausted, the replacement of a cartridge should be performed by a user in person, and therefore, means for warning a user that the developer is exhausted, i.e., a developer amount detecting device, is required.

As a developer amount detecting device, a residual developer amount detecting means which can detect a residual developer amount level is located in a cartridge or an image forming apparatus main body in order to make it possible to find at any time how much developer is left to form images in the cartridge.

There is a electrostatic capacitance detecting method as one method of this residual developer amount detecting means. This is the method for detecting a residual developer amount utilizing the change of a current induced in an antenna in accordance with the developer amount existing between an electrode and the antenna when the antenna for detecting the residual developer amount is disposed in a developer container and an AC voltage is applied to the electrode located at a predetermined position.

For example, there is the flat antenna method as one of using the electrostatic capacitance detecting method. A flat antenna has a pair of conductor patterns 22, 23 formed in a predetermined interval on a substrate 21, and is, for example, disposed on a side of a developer container and on which the antenna contacts the developer, as the amount of the developer in the developer container decreases, so as to decrease the contacting area between the developer and the flat antenna 20.

The electrostatic capacity varies as the contacting area of the conductor pattern surface and the developer changes due to the consumption of the developer, thereby making it possible to interrelate the residual developer amount in the container with the electrostatic capacity of the flat antenna, and to find the residual developer amount in the container at any time by measuring the electrostatic capacity of the flat antenna.

By applying a constant alternate current bias on one of the pair of conductor portions 22, 23, the electrostatic capacity of the flat antenna 20 can be found from current flowing to the other conductor part at that time.

In addition, as another example using the electrostatic capacity detecting method, there is the plate antenna method configured with a metal plate (a plate antenna) provided in parallel with a developing roller in what is called the jumping developing method for developing a latent image on a photosensitive body by applying an alternating bias on the developing roller that is a developer carrying body disposed in a developer container.

This method utilizes the change of an electrostatic capacitance between the plate antenna and the developing roller depending on the amount of insulating developer existing between them. The electrostatic capacitance is large if a cavity between the plate antenna and the developing roller is filled with the developer, and air in the cavity increases as the developer decreases so that the electrostatic capacitance gets smaller. Therefore, the developer amount can be detected by relating the electrostatic capacitance with the developer amount between the plate antenna and the developing roller in advance.

As a measuring method of the electrostatic capacitance, the electrostatic capacitance can be found by measuring a current flowing to the plate antenna when an alternating bias, which is a developing bias, is applied on the developing roller. That is, this residual developer amount detecting method can detect a residual developer amount at the time of image formation when a developing bias is applied on the developing roller.

By providing the above described residual developer amount detecting means in a developer containing portion, i.e., a developer container, a residual developer amount capable of serving an image formation function can be found at any time.

In addition, as residual developer amount detecting means, there is the torque detection method in which a developer agitating means is provided in a developer container, for detecting a residual developer amount utilizing the change of load applied on developer agitating means depending on a residual developer amount.

By using such a serial residual developer amount detecting method, a user can be informed of how many more images can be formed until a replacement of a process cartridge, a developing device or the like formed into cartridge, a supplement of developer into the cartridge, or the like becomes necessary.

However, in any of the serial residual developer amount detecting methods, although it is possible to find at any time how much developer capable of serving an image formation is left, sufficient accuracy of detection has not been attained due to a limit in measurement resolution, a measurement error and the like, and the accuracy of detection concerning the printable number of sheets from the present onward is not yet satisfactory.

Thus, means is expected to be developed that informs the user precisely how many more images can be formed until a replacement of a process cartridge, a developing device or the like formed into cartridge, a supplement of developer into the cartridge, or the like becomes necessary.

The present invention relates to a further improvement of an image forming apparatus and a cartridge detachably attachable to the image forming apparatus as described above.

SUMMARY OF THE INVENTION

The present invention has been made in view of the above problems, and therefore has an object to provide an image forming apparatus capable of accurately detecting the remaining printable number of sheets, and to provide a cartridge detachably attachable to the image forming apparatus.

Another object of the present invention is to provide an image forming apparatus capable of accurately indicating the remaining printable number of sheets, and to provide a cartridge detachably attachable to the image forming apparatus.

Still another object of the present invention is to provide an image forming apparatus comprising:

a developer container for containing a developer;

developer amount detecting means for detecting an amount of the developer contained in the developer container;

a pixel number counter for counting the number of pixels required for forming an image;

a sheet number counter for counting the number of sheets of a recording material on which an image is formed; and calculating means for calculating the printable number of sheets from the present onward using the developer amount detected by the detecting means, the number of pixels counted by the pixel number counter and the number of sheets counted by the sheet number counter.

Yet still another object of the present invention is to provide a cartridge comprising:

a developer container; and a memory for memorizing a developer amount detected by a detecting means for detecting an amount of a developer contained in the developer container, the number of pixels counted by a pixel number counter, and the number of sheets counted by a sheet number counter.

Further objects of the present invention will become apparent by reading the following detailed description with reference to the attached drawings.

DETAILED DESCRIPTION OF THE PREFERRED EMBODIMENTS

Figure 1:
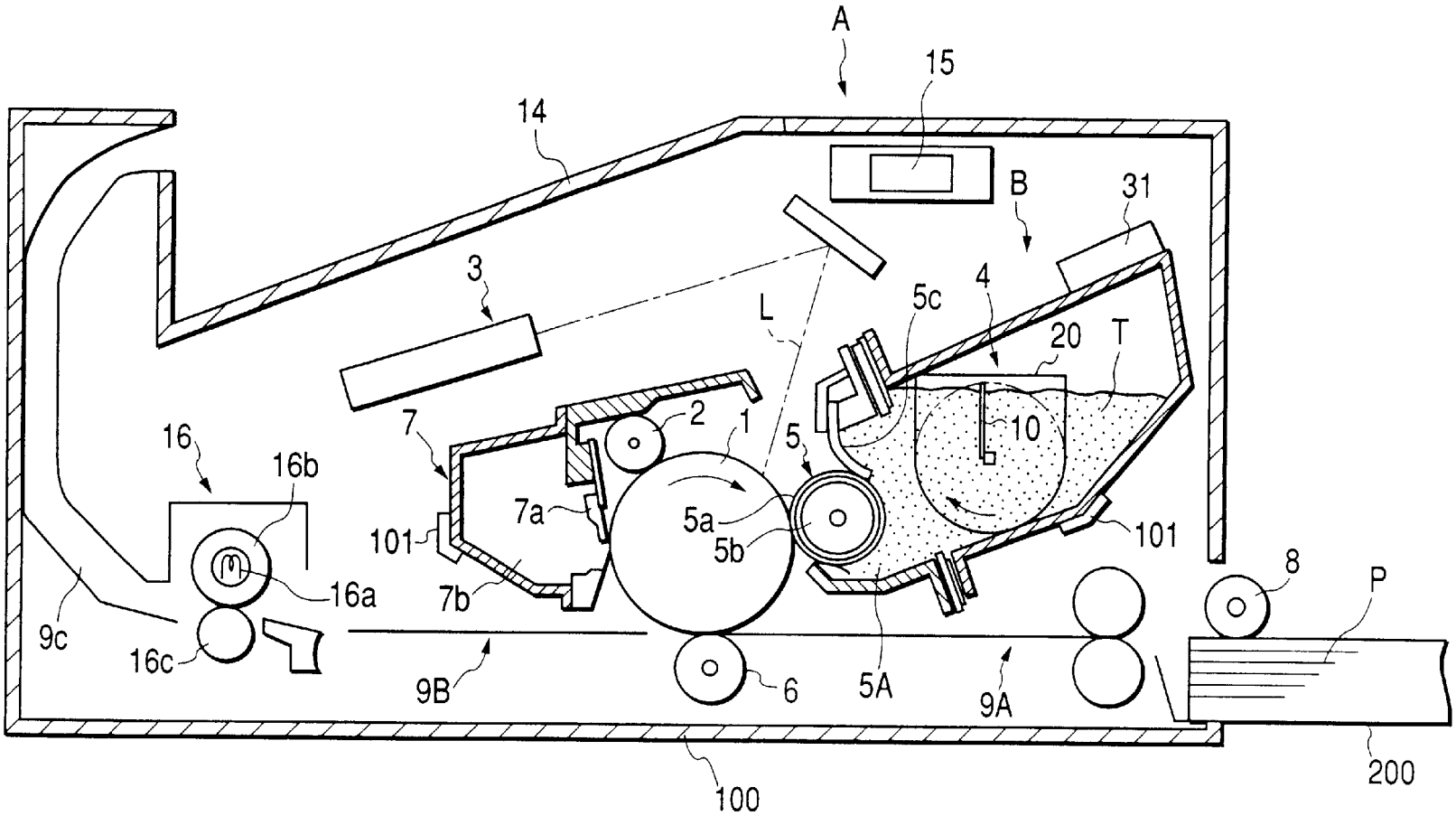
FIG. 1 is a cross sectional view of an embodiment of a process cartridge and an image forming apparatus of the sent invention.

An image forming apparatus and a cartridge detachably attachable to the image forming apparatus in accordance with the present invention is explained in detail hereinafter with reference to the accompanied drawings.

(First Embodiment)

An embodiment of an electrophotographic image forming apparatus which is configured in accordance with the present invention, and to which a process cartridge is insertable will first be described with reference to FIG. 1 through FIG. 3. In this embodiment, an electrophotographic image forming apparatus is designated as a laser beam printer A of the electrophotographic type and forms an image on a recording material, for example, recording paper, an OHP sheet and cloth by an electrophotographic image forming process.

The laser beam printer A has a drum-shaped electrophotosensitive body, i.e., a photosensitive drum 1. The photosensitive drum 1 is charged by a charging roller 2 being a charging means, and then a latent image corresponding to image information is formed on the photosensitive drum 1 by irradiating the drum 1 with a laser beam L corresponding to image information from a laser scanner 3. The latent image is developed by a developing means 5 and is made a visible image, i.e., a toner image.

That is, the developing means 5 has a developing chamber 5A provided with a developing roller 5*a* as a developer bearing body and forwards developer T in the developer container 4 being a developer containing portion formed adjacent to the developing chamber 5A to the developing roller 5*a* of the developing chamber 5A by the rotation of a developer forwarding member 10. In this embodiment, an insulating one component toner is used as the developer T. In addition, the developing roller 5*a* incorporates a fixed magnet 5*b*, and the developer is conveyed by rotating the developing roller 5*a*, applying friction electrifying charge by a developing blade 5*c*, making a developer layer with a predetermined thickness, and supplying it to a developing region of the photosensitive drum 1. The developer supplied to the developing region is transferred to the latent image on the photosensitive drum 1 and forms a toner image. The developing roller 5*a* is connected to a developing bias circuit which usually applies developing bias voltage which is alternating current voltage, superimposed on direct current voltage.

On the other hand, a recording material P set in a sheet feeding cassette 200 synchronously with the formation of a toner image is conveyed to a transferring position via pick-up roller 8 and conveying means 9A. A transferring roller 6 is disposed as transferring means at the transferring position and transfers the toner image on the photosensitive drum 1 to the recording material P by applying voltage.

The recording material P having received the transfer of the toner image is conveyed onto a fixing means 16 by a conveying means 9B. The fixing means 16 is provided with a fixing roller 16*b* incorporating a heater 16*a* and a driving roller 16*c*, and applies heat and voltage onto the recording material P passing through thereon so as to fix the transferred toner image on the recording material P.

The recording material P is discharged to a discharging tray 14 by a conveying means 9C. The discharging tray 14 is provided on the upper surface of an apparatus main body 100 of the laser beam printer A.

The photosensitive drum 1, after transferring the toner image on the recording material P by the transferring roller 6, undergoes the next image forming process after removing the developer remained on the photosensitive drum 1 by cleaning means 7. The cleaning means 7 scratches off the remaining developer on the photosensitive drum 1 by an elastic cleaning blade 7*a* provided in contact with the photosensitive drum 1 and collects the remained developer in a waste developer retaining tank 7*b*.

Figure 2:
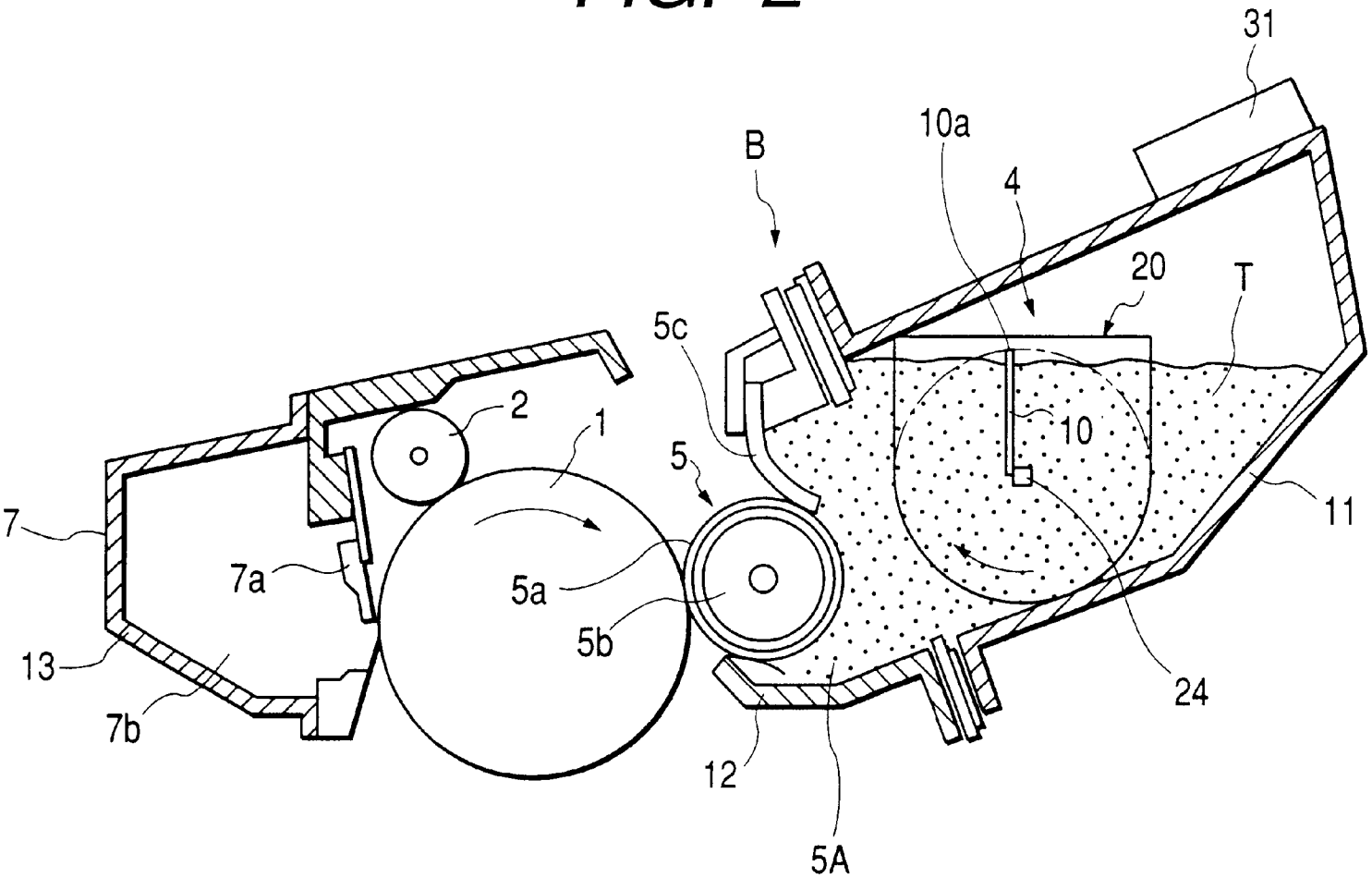
FIG. 2 is an enlarged cross sectional view of a process cartridge of FIG. 1.

On the other hand, in this embodiment, in a process cartridge B, as shown in FIG. 2, a developing unit is formed by integrally welding a developer frame body 11 having a developer container 4 containing a developer and a developer forwarding member 10, and a developing frame 12 holding a developing means 5 such as a developing roller 5*a* and a developing blade 5*c*, and the cartridge is formed by integrally assembling the developing unit and a cleaning frame body 13 containing the photosensitive drum 1, the cleaning means 7 such as a cleaning blade 7*a* and the charging roller 2.

The process cartridge B is equipped detachably attachable with cartridge inserting means 101 (FIG. 1) provided in the image forming apparatus main body 100 by a user.

In accordance with the present embodiment, the process cartridge B has a developer amount detecting device 30 provided with the residual developer amount detecting means 20 capable of serially detecting the residual amount in accordance with the consumption of the developer T in the developer container 4.

The image forming apparatus of this embodiment is characterized by comprising a means for detecting the number of pixels required for image formation by a statistical calculation and a calculating means for calculating the printable number of sheets from the present onward by a statistical calculation, and the process cartridge is characterized by comprising a residual developer amount detecting means and a memory means for memorizing the residual developer amount level of each cartridge, even if the process cartridge is replaced and a new cartridge is used. In addition, each means will now be described with reference to the drawings.

(Residual Developer Amount Detecting Means)

In this embodiment, in a developer amount detecting apparatus 30, the electrostatic capacitance detecting method with a flat antenna disposed in the process cartridge is adopted as a residual developer amount detecting means.

That is, in accordance with this embodiment, as described above, an agitating means 10 rotating in a direction designated by an arrow of FIG. 1 is provided in the developer container 4, and the developer T is supplied to the developing roller 5*a* while being softened by the rotation of the agitating means 10. In addition, a flat antenna 20 as shown in FIG. 3, being the residual developer amount detecting means is disposed on the internal wall of the developer container 4.

The flat antenna 20 is a generally used printed substrate 21 with two conductor patterns 22, 23 formed on it by etching or printing. In addition, in order to protect this circuit graphics, a protective film (not shown) is formed on the conductor patterns 22, 23. The conductor pattern may be set appropriately, and in this embodiment, the width (W) of two conductor patterns 22, 23 of the flat antenna 20 is set at 300 $\mu$m and the interval (G) between both the conductor patterns 22, 23 is as small as approximately 300 $\mu$m.

Figure 5:
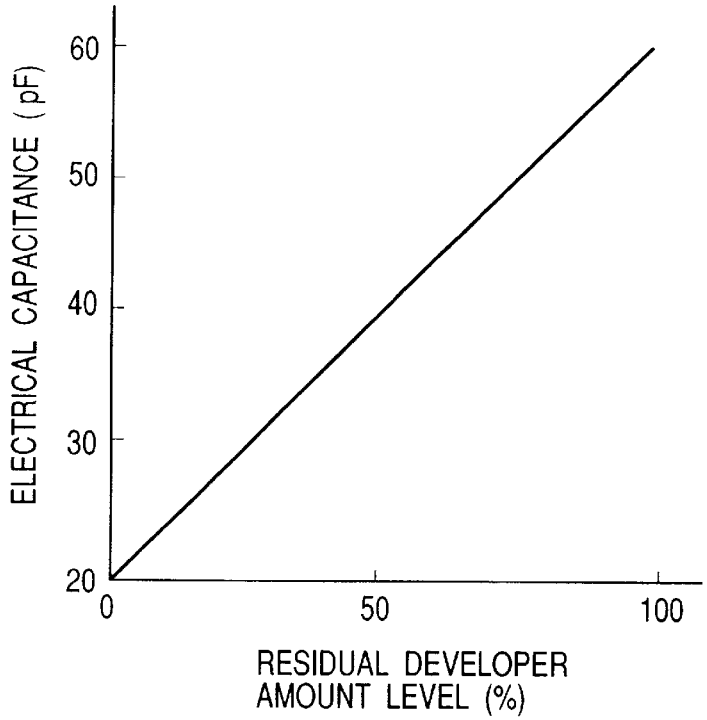
FIG. 5 is a graph showing the relationship between a residual developer amount level and an electrostatic capacitance.

In the flat antenna 20 of this embodiment, when 200 Vpp, 2000 Hz were applied as an alternating bias between the electrodes 22, 23 of each conductor pattern, different electrostatic values of 20 pF at the time when the developer did not touch the flat antenna 20 and 60 pF at the time when the developer touched the entire surface of the flat antenna 20 were observed. By disposing this flat antenna 20 on the internal wall of the developer container 4, the contacting area of the developer T and the flat antenna 20 decreases with the decrease of the developer T in the container 4, and the amount of the developer T in the container 4 can be found at any time by observing the electrostatic capacitance between two conductor patterns (antennas 22 and 23). The relationship between the residual developer amount level and the electrostatic capacitance is shown in FIG. 5.

However, in fact, even if the developer T in the container 4 decreases gradually, dispersion arises in the measurement results due to a little residual developer sticking on the flat antenna 20.

Therefore, in order to remove the developer sticking on the surface, an antenna cleaning member 10*a* is provided on the end portion of the agitating means 10 to clean the surface of the flat antenna 20 with rotation of the agitating means 10.

The antenna cleaning member 10*a* is a sheet made of, for example, PET (polyethylene terephthalate) and cleans the surface of the flat antenna 20 in a stroking manner.

Figure 3:
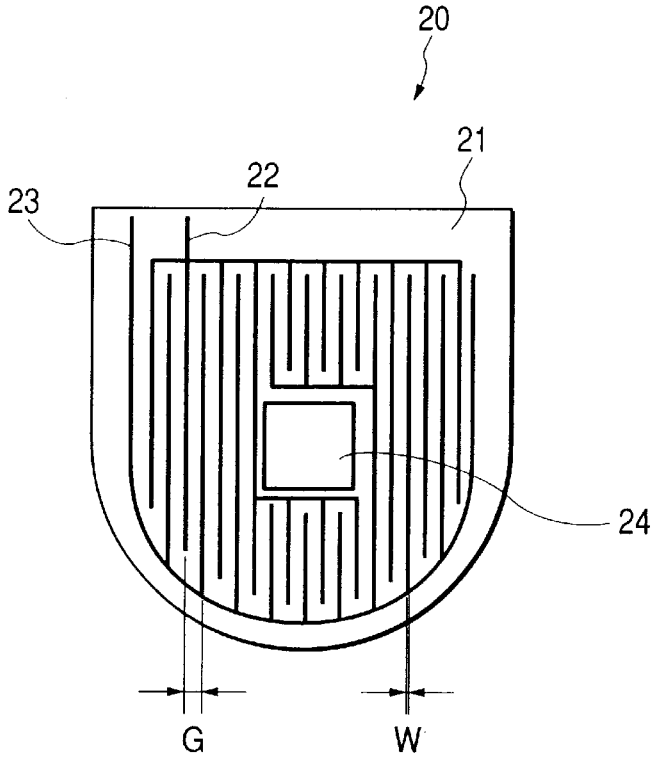
FIG. 3 illustrates residual developer amount detecting means that can be mounted on a process cartridge of the present invention.

As shown in FIG. 3, by providing a hole 24 in substantially the center portion of the flat antenna 20 and rotatably supporting the agitating means 10 against the developer container 4 and the like by passing a shaft for supporting the agitating means 10 through the hole 24, the entire region of the flat antenna 20 can be substantially cleaned by a surface cleaning means 10*a*.

Although the dispersion of the measurement results due to a little residual developer sticking on the flat antenna 20 can be dissolved with the above-mentioned configuration, as the developer flows by the rotation of the agitating means 10, the output of the flat antenna 20 fluctuates with the rotation cycle of the agitating means 10.

Thus, the residual developer amount level is confirmed by performing statistical processing such as finding an average or selecting a minimum value of antenna outputs according to the rotation cycle of the agitating means 10. The signal processing means executing the above processing are disposed in the image forming apparatus main body 100.

As a residual developer amount detecting resolution by the flat antenna method in this embodiment, in consideration of a limit in measurement resolution, a measurement error, and the like, the residual developer amount detecting means 20 can perform detection with the decreasing ratio of 1% when the developer amount in a virgin developer container, that is, the full developer amount in the developer containing portion 4 is assumed to be 100%.

In this embodiment, although, as means for detecting the number of pixels required for image formation by a statistical calculation, laser light emitting total time detection means is adopted, the means is not limited to this as far as it detects the number of pixels, and printing character amount information based on an image signal can be utilized.

(Means for Detecting the Number of Pixels Required for an Image Formation by a Statistical Calculation)

In this embodiment, although, as means for detecting the number of pixels required for an image formation by a statistical calculation, laser light emitting total time detection means is adopted, the means is not limited to this as far as it detects the number of pixels, and printing character amount information based on an image signal can be utilized.

Figure 4:
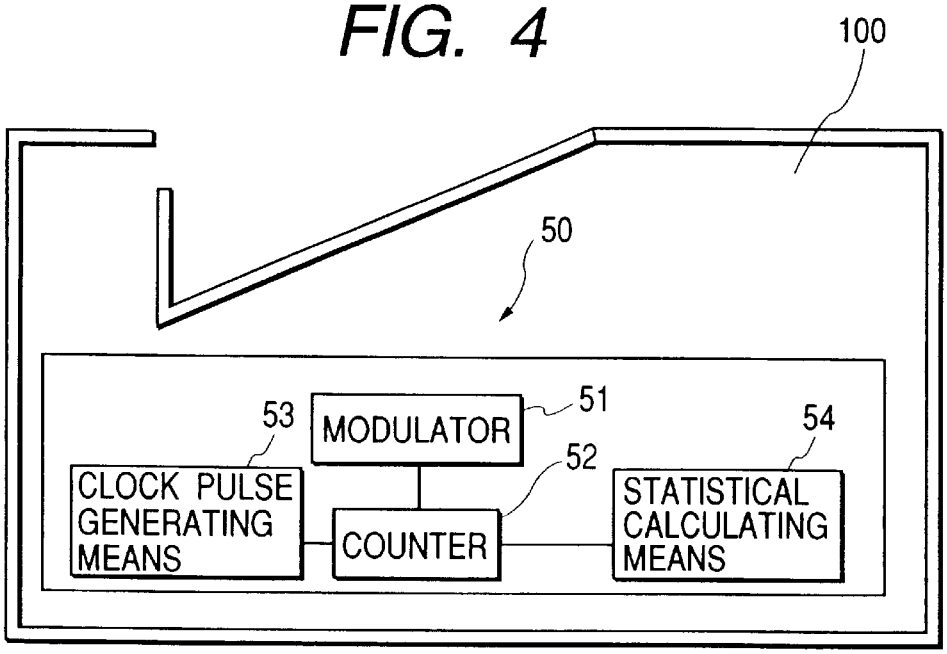
FIG. 4 is a schematic illustration of means for detecting the number of pixels required for image formation by a statistical calculation used in the present invention.

The overall configuration of laser light emitting total time detecting means 50 in the laser beam printer A of the present invention is shown in FIG. 4. The laser light emitting total time detecting means 50 includes a modulator 51 for modulating an image signal inputted from a computer and the like to a laser input voltage to turn on and off the laser corresponding to the image signal.

A counter 52 is connected to the modulator 51 and measures the outputting time from the modulator 51 to the laser, that is, time information corresponding to the exposure time of a laser beam to a photosensitive drum 1. That is, clock pulse generating means 53 being a crystal oscillator is connected to the counter 52 and the number of clock pulses that are received during a period when a laser light emitting signal continues is counted.

The number of pixels required for image formation is calculated from the counted number by a statistical calculating means 54. By continuing to add counted numbers since the start of use, the sum of the number of pixels can also be calculated.

(Memory Means)

In addition, in accordance with the present invention, by writing a residual developer amount level value in the developer container 4 into a memory means mounted on a process cartridge B, even if a plurality of cartridges are replaced and used, a residual developer amount level of the respective cartridges can be stored. As the memory means 31, a nonvolatile memory capable of reading and writing is adopted.

Figure 6:
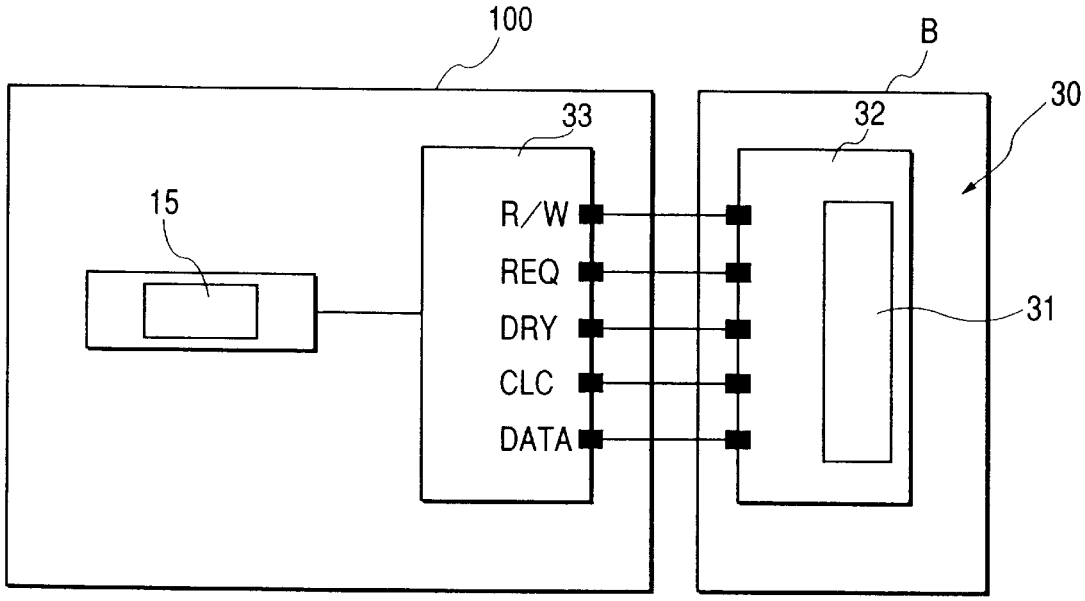
FIG. 6 is a schematic illustration describing the relationship between memory means provided in a process cartridge and display means provided in an image forming apparatus of the present invention.

In this embodiment, as shown in FIG. 6, a nonvolatile memory 31 as memory means and a cartridge side control portion 32 for controlling writing and reading information in and from the nonvolatile memory 31 are disposed in the process cartridge B. When the process cartridge B is loaded on the image forming apparatus main body 100, the cartridge side control portion 32 and the control portion 33 in the image forming apparatus main body 100 side are mutually connected by each signal line of R/W, REQ, DRY, CLC and DATA. In this way, controlling means for writing and reading information in and from the memory means 31 is configured by the control portion 33 in the image forming apparatus main body side and the cartridge side control portion 32.

When data is written in and read from the nonvolatile memory 31 which is a memory means, an appropriate waiting time is set depending on the characteristic of a device used so as to guarantee its operation.

The nonvolatile memory 31 used in this embodiment is a memory of the serial data input output type, and its memory capacity can be arbitrary. In this embodiment, a memory with capacity sufficient for memorizing a plurality of data such as the number of printed recording materials added by the counter 61 (FIG. 7) to be described below, the above-mentioned number of pixels calculated by the laser light emitting total time detecting means 50, the total sum of the number of pixels, the residual developer amount level, the statistical calculation result of the printable number of sheets from the present onward as described below, is used. Although a writing and reading control portion with respect to the memory means 31 is also provided in the image forming apparatus, generation of an electric error, noise and the like can be decreased by providing all in the process cartridge side.

(Calculating Means for Calculating the Printable Number of Sheets from the Present Onward by a Statistical Calculation)

Figure 7:
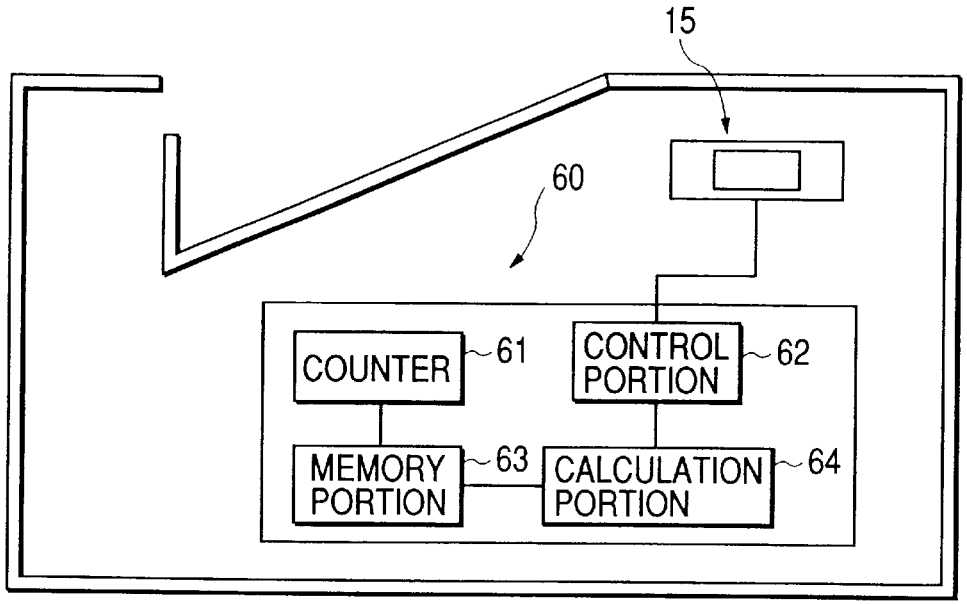
FIG. 7 is a schematic illustration of calculating means for calculating the printable number of sheets from the present onward by a statistical calculation used in the present invention.

As shown in FIG. 7, calculating means 60 for calculating the printable number of sheets from the present onward by a statistical calculation has a counter 61, a control portion 62, a memory portion 63, a calculation portion 64 and the like.

The counter 61 is for adding the number of printed recording materials. A nonvolatile memory is adopted as the memory portion 63 in this embodiment, which may have sufficient capacity for memorizing a plurality of data such as the number of printed recording materials added by the counter 61, the above-mentioned number of pixels calculated by the laser light emitting total time detecting means 50, the total sum of the number of pixels, the residual developer amount level, and the statistical calculation result of the printable number of sheets from the present onward to be described later. In addition, as in this embodiment, the capacity can be decreased by memorizing these values in the memory means 31 of the process cartridge.

The calculation portion 64 calculates the printable number of sheets from the present onward by a statistical calculation. In performing the calculating operation, a value necessary for the calculation may be able to be read out from the memory portion 63, or as in this embodiment, can be read out from the memory means 31 by memorizing these values into the memory means 31 of the process cartridge B.

The user is informed of the calculated printable number of sheets from the present onward on the display portion 15 connected to the calculation portion 60. As an alternative, a signal relating to the calculated printable number of sheets from the present onward can be outputted and transmitted to a personal computer that can communicate with the image forming apparatus, and can also be indicated on the display of a personal computer.

A calculation method of the printable number of sheets from the present onward (W) in this embodiment will now be described.

The printable number of sheets from the present onward is an estimated number which is obtained by estimating two values of the number of pixels required for forming one sheet of an image and a consumed developer amount for a unit number of pixels and, thereafter, performing an estimating operation from the current residual developer amount based on these two values. This estimate is represented by the following equation:

The printable number of sheets from the present onward (W)=(Current residual developer amount level)/[(Estimate of the number of pixels required for forming one sheet of an image)×(Estimate of the number of pixels required for a unit number of pixels)]

(The Number of Pixels Required for Forming One Sheet of an Image)

The number of pixels required for forming one sheet of an image naturally changes depending on the status of use by a user such as a text document, a graphic image and the like. Thus, the status of use from the present onward is inferred using an average of the number of pixels required for one sheet of image formation in the status of use to date in terms of an average status of use of a user to date.

(Amount of Consumed Developer Per Unit Pixel)

Figure 8:
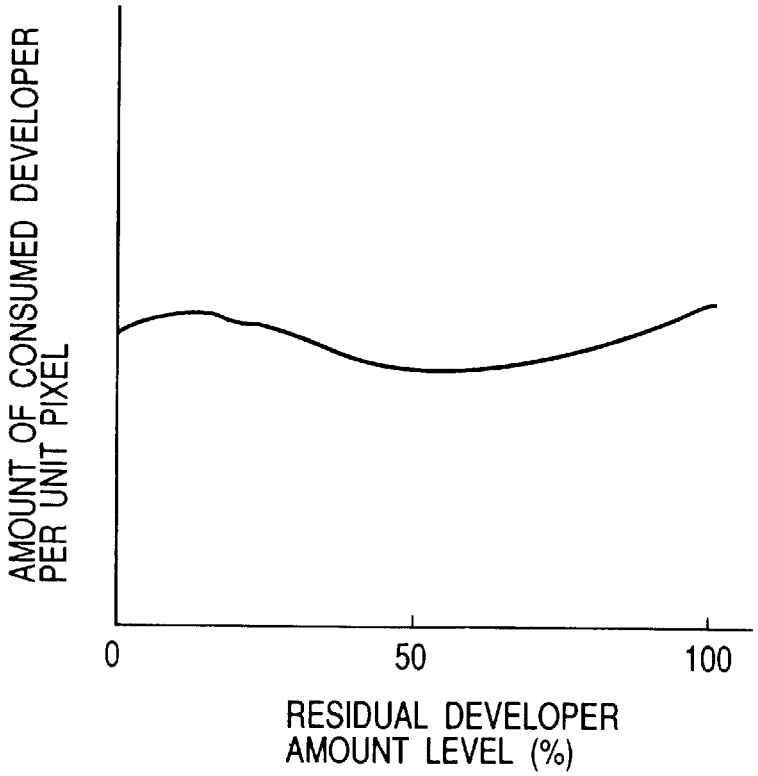
FIG. 8 is a graph showing the relationship between a residual developer amount level and a consumed developer amount per unit pixel.

Changes in each residual developer amount level of a consumed developer amount per unit pixel are shown in FIG. 8.

That is, even if identical images are successively outputted, the residual developer amount level and the consumed developer amount per unit pixel do not change linearly. The developer amount to be required for developing unit pixels always changes. This is considered to be attributable to endurance deterioration of means involved in the developer and developing, deterioration of a photosensitive drum, as well as the influence of the ambient environment and the like, or is considered to be affected by all of these in a complex manner.

Thus, in this embodiment, a consumed developer amount per unit pixel is calculated by a statistical method in consideration of the relation of a consumed developer amount per unit pixel in the above-mentioned each residual developer amount level.

That is, since a developer amount to be required for developing unit pixels always changes, a consumed developer amount per unit pixel in an image formation operation from the present onward is estimated by using a weighting factor on a consumed developer amount per unit pixels in the past.

Although the printable number of sheets from the present onward is always calculated using a statistical method and is communicated to a user, it is not considerably important until a time when the residual developer amount is running short and replacement of cartridges, such as a process cartridge or a supplement of developer to a cartridge or the like becomes necessary, is approaching, and at that time the importance increases.

Thus, in this embodiment, assuming that the full amount of developer in the unused state in the developer container 4 is 100%, when a residual developer amount decreases to 20%, i.e., 200 g in the case of the process cartridge of this embodiment, the printable number of sheets from the present onward is communicated to a user.

A weighting factor in this embodiment will now be described.

(Weighting Factor)

In this embodiment, the duration of using the image forming apparatus to date is divided into periods using a residual developer amount level. When the current residual developer amount level is X g, each of the period is represented as follows:

Period I: $X$ g to (X+50) g,

Period II: (X+50 g) to (X+100) g,

Period III: ($X$+100 g) to ($X$+200 g),

Period IV: ($X$+200 g) to 500 g,

Period V: 500 g to 1000 g

Figure 9:
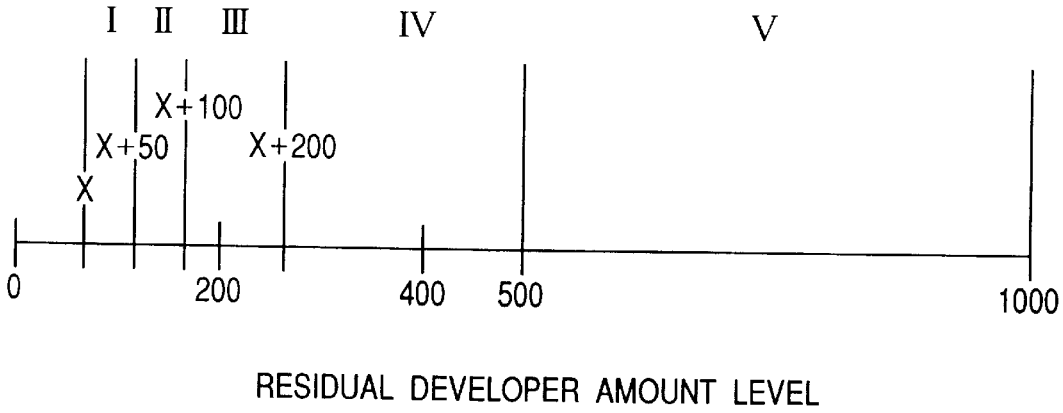
FIG. 9 illustrates divisions of the residual developer amount level.
Figure 10:
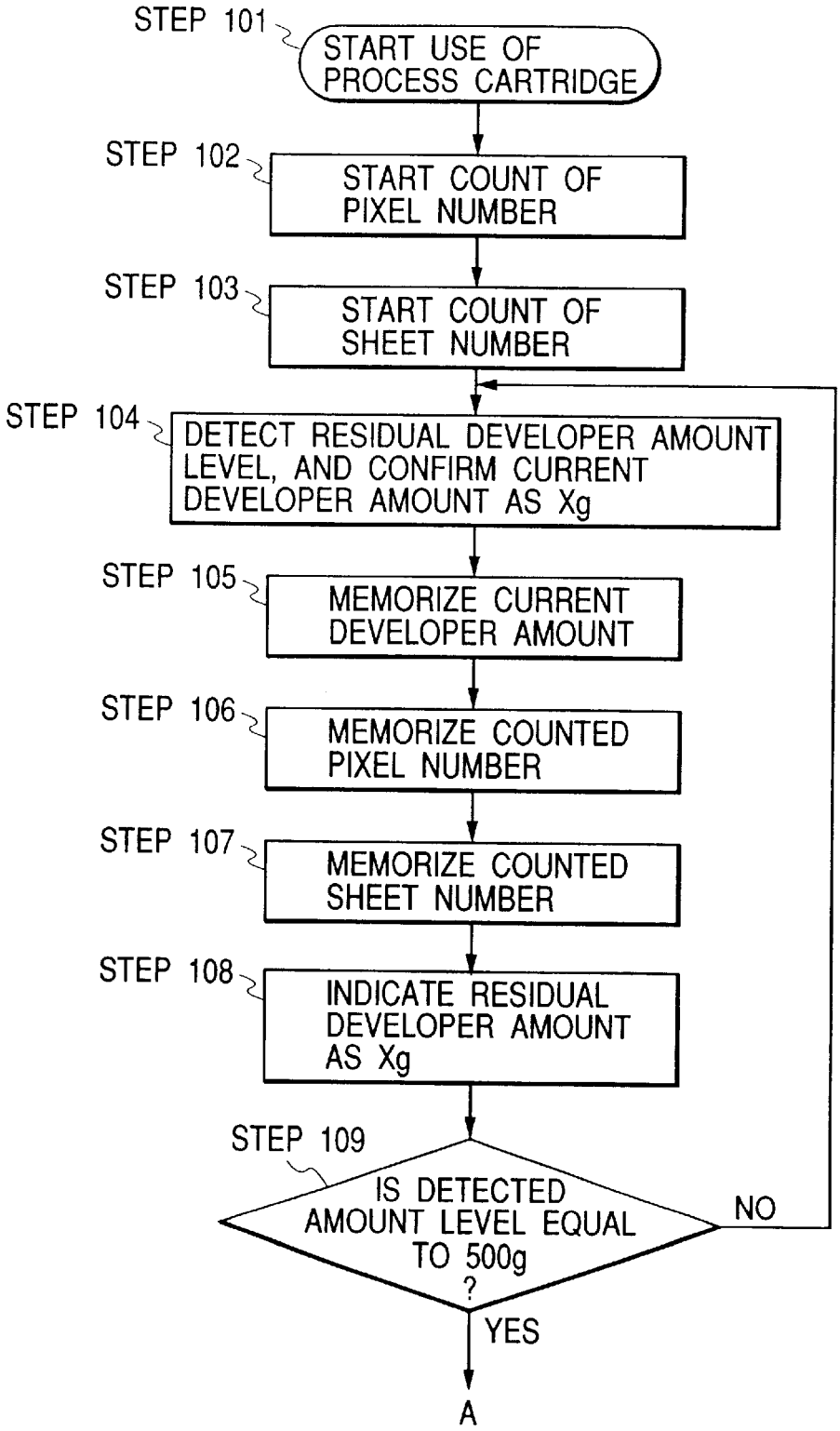
FIG. 10 is a flow chart describing an operation for indicating the printable number of sheets from the present onward in accordance with the present invention.
Figure 11:
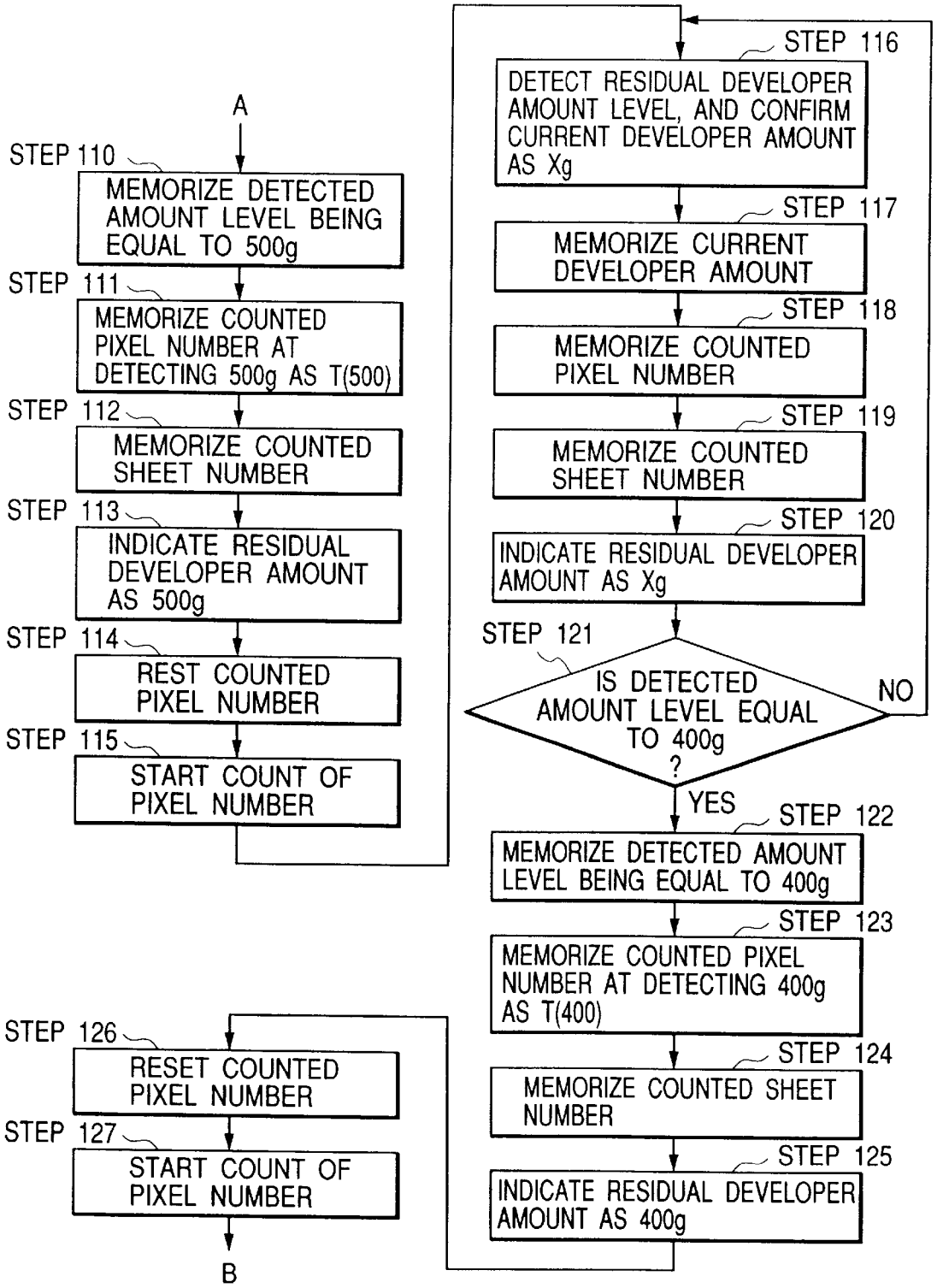
FIG. 11 is a flow chart describing operation for indicating the printable number of sheets from the present onward in accordance with the present invention.
Figure 12:
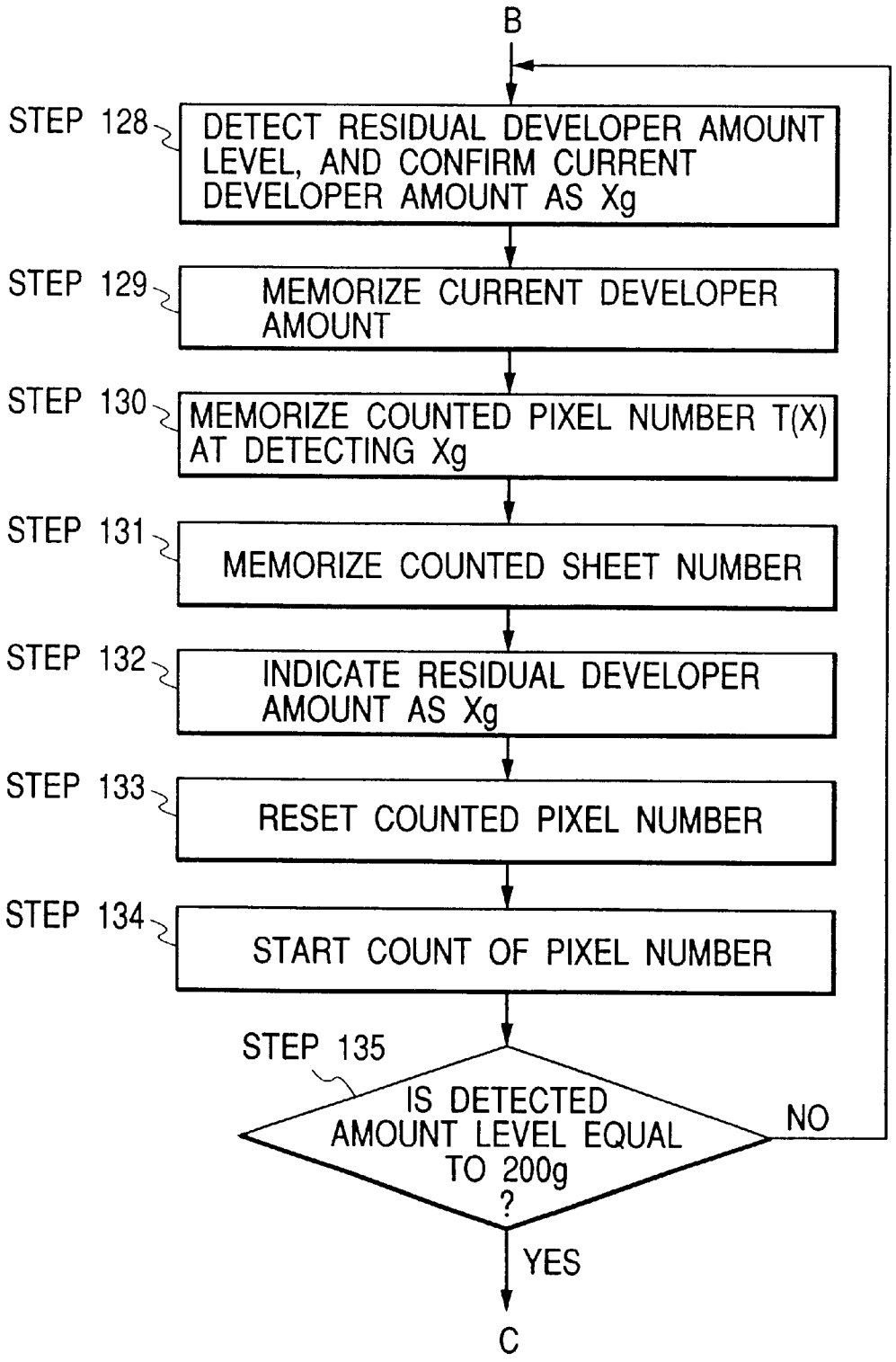
FIG. 12 is a flow chart describing an operation for indicating the printable number of sheets from the present onward in accordance with the present invention.

These are shown in FIG. 9. The division is not limited to the above of course and is characterized in that a period closer to the present is getting shorter.

With a residual developer amount level decreasing, the intervals of Period I to Period III and Period V do not change but Period IV is only extended.

A residual developer amount per unit pixel is calculated by the following equation:

A residual developer amount per unit pixel=(A consumed developer amount)/(The number of pixels required for an image formation).

When the number of pixels in each period is T (period), a consumed developer amount A (period) per unit pixel is represented as follows:

Period I: $A$ (I)=50 g/$T$ (I),

Period II: $A$ (II)=50 g/$T$ (II)

Period III: $A$ (III)=100 g/$T$ (III)

Period IV: $A$ (IV)=(300−$X$) g/$T$ (IV)

Period V: $A$ (V)=500 g/$T$ (V)

Here, when a weighting factor is as follows:

Period I: $\alpha$=0.4, Period II: $\beta$=0.25, Period III: $\gamma$=0.2, Period IV: $\alpha$=0.1, Period V: $\epsilon$=0.05 ($\alpha+\beta+\gamma+\delta+\epsilon=1$)

the consumed developer amount A per unit pixel from the present onward is calculated as follows:

$$A=0.4\times A(\mathrm{I})+0.25\times A(\mathrm{II})+0.2\times(\mathrm{III})+0.1\times A(\mathrm{IV})+0.05\times A(\mathrm{V})$$

In this way, an estimate of a consumed developer amount per unit pixel from the present onward becomes accurate. Further, the past closer to the present (Period I) has a larger weighting factor than the past distant from the present (Period V). This is because the past closer to the present is more likely to have a use status similar to that in the future than the past distant from the present.

As described above, a consumed developer amount per unit pixel from the present onward is calculated by using a weighting factor on a consumed developer amount per unit pixel in the past. Naturally, values of a weighting factor and a division of each period are not limited to the above but can be determined appropriately.

A method of calculating the printable number of sheet from the present onward (W) will now be described.

(The Printable Number of Sheets from the Present Onward (W))

The following values are necessary for calculating the printable number of sheets from the present onward (W):

1. The current residual developer amount level (X g):

As described above, this is determined by the developer amount detecting apparatus 30 provided with the residual developer amount detecting means 20.

2. The number of recording materials that have been printed to the present (Y):

This is an added value added by the counter 61 forming the calculating means 60.

3. The number of pixels required for an image formation in Period I through Period V:

This is a value calculated from the counter 52 in the laser light emitting total time detecting means 50.

In the case of this embodiment, since a calculation of the printable number of sheets from the present onward is started from the residual developer amount of 200 g, a value in Period V and a value between 500 g to 400 g in Period IV are simply added and memorized in the memory means, and a residual value is memorized thereafter for every 10 g as described later.

4. The total sum of the number of pixels to the present (T):

This is a value calculated from an added value which is a value continuously added by the counter 52 of the laser light emitting total time detecting means 50 since a process cartridge is started to be used.

The above values are output from each means and the calculation portion 64 performs the following calculation based on these values:

5. The average number of pixels per one sheet of a recording material=(The sum of the number of pixels to the present)/(The number of recording materials printed to the present) (T/sheet).

A correcting factor may be used depending on the size of a recording material.

6. A consumed developer amount per unit pixel=(A consumed developer amount)/(The number of pixels required for an image formation)=A=(g/T).

In this embodiment, as described above, A is calculated as follows:

$$A=0.4\times A(\mathrm{I})+0.25\times A(\mathrm{II})+0.2\times A(\mathrm{III})+0.1\times A(\mathrm{IV})+0.05\times A(\mathrm{V})$$

7. The printable number of sheets from the present onward (W)=(The current residual developer amount level)/[(The average number of pixels per one sheet of a recording material)×(A consumed developer amount per unit pixel)]

In this way, the printable number of sheets from the present onward (W) is calculated and is communicated to a user by the display means 15 or a display of a personal computer.

As described above, the value of a weighting factor and other values used in this embodiment are not limited to the above.

In addition, the operation of the image forming apparatus in accordance with this embodiment will now be described with reference to flow charts shown in FIGS. 10 through 14.

1. Operation from the time when a process cartridge is started to be used until the time when a residual developer amount level is detected as 500 g.

Step 101: A process cartridge is started to be used.

Step 102: The laser light emitting total time detecting means 50 starts to count the number of pixels required for an image formation.

Step 103: The counter 61 provided in the calculating means 60 starts to count the number of sheets of a recording material.

Step 104: The residual developer amount detecting means 20 confirms a residual developer amount level.

Step 105: The residual developer amount level is memorized in the memory means 31 of the process cartridge.

Step 106: The count of the number of pixels is memorized in the memory means 31 of the process cartridge.

Step 107: The count of the number of sheets is memorized in the memory means 31 of the process cartridge.

Step 108: The display means 15 or a display of a personal computer indicates the residual developer amount level memorized in the memory means 31 of the process cartridge.

Step 109: The residual developer amount detecting means determines whether the residual developer amount level is detected as 500 g or not. If it detected that the residual developer amount is 500 g (YES), the process proceeds to A, and if it did not detect the residual developer amount (NO), the process returns to step 104 and repeats the step.

From the time when a process cartridge is started to be used until the time when residual developer amount level is detected as 500 g, a residual developer amount level memory, a pixel number memory and a sheet number memory of the memory means 31 of the process cartridge are updated as described above.

2. Operation from the time when a residual developer amount level is detected as 500 g until the time when a residual developer amount level is detected as 400 g.

Step 110: The residual developer amount level of 500 g detected by the residual developer amount detecting means 20 is memorized in the memory means 31 of the process cartridge.

Step 111: The number of pixels up to this time (the total of the number of pixels from the time of starting use until the time when the residual developer amount level is detected as 500 g) is memorized in the memory means 31 of the process cartridge, and is further memorized in a storing region and made unrewritable.

Step 112: The count of the number of sheets is memorized in the memory means 31 of the process cartridge.

Step 113: The display means 15 or a display of a personal computer indicates the residual developer amount level memorized in the memory means 31 of the process cartridge.

Step 114: The count of the number of pixels of the laser light emitting total time detecting means 50 is reset.

Step 115: The laser light emitting total time detecting means 50 resumes the count of the number of pixels required for an image formation.

Steps 116 through 120: The same as the above-mentioned Steps 104 through 108.

Step 121: The residual developer amount detecting means 20 determines whether the residual developer amount level is detected as 400 g or not. If NO, the process returns to Step 116 and is repeated.

Step 122: The residual developer amount level of 400 g detected by the residual developer detecting means 20 is memorized in the memory means 31 of the process cartridge.

Step 123: The number of pixels up to this time (the total of the number of pixels from the time when the counter is reset at 500 g until the time when the residual developer amount level is detected as 400 g) is memorized in the memory means 31 of the process cartridge, and is further memorized in a storing region and made unrewritable.

Steps 124 through 127: The same as the abovementioned Steps 112 through 115.

As described above, the number of pixel memories at the time when the residual developer amount levels 500 g and 400 g are detected are stored and used in calculating a weighting factor and a sum of the number of pixels.

3. Operation from the time when a residual developer amount level is detected as 400 g until the time when a residual developer amount level is detected as 200 g.

Step 128: The residual developer amount detecting means 20 confirms the residual developer amount level as X g.

Step 129: The residual developer amount level is memorized in the memory means 31 of the process cartridge.

Step 130: The number of pixels up to this time is memorized in the memory means 31 of the process cartridge and is further memorized in a storing region and made unrewritable.

Step 131: The count of the number of sheets is memorized in the memory means 31 of the process cartridge.

Step 132: The display means 15 or a display of a personal computer indicates the residual developer amount level memorized in the memory means 31 of the process cartridge.

Step 133: The count of the number of pixels of the laser light emitting total time detecting means 50 is reset.

Step 134: The laser light emitting total time detecting means 50 resumes the count of the number of pixels required for image formation.

Figure 13:
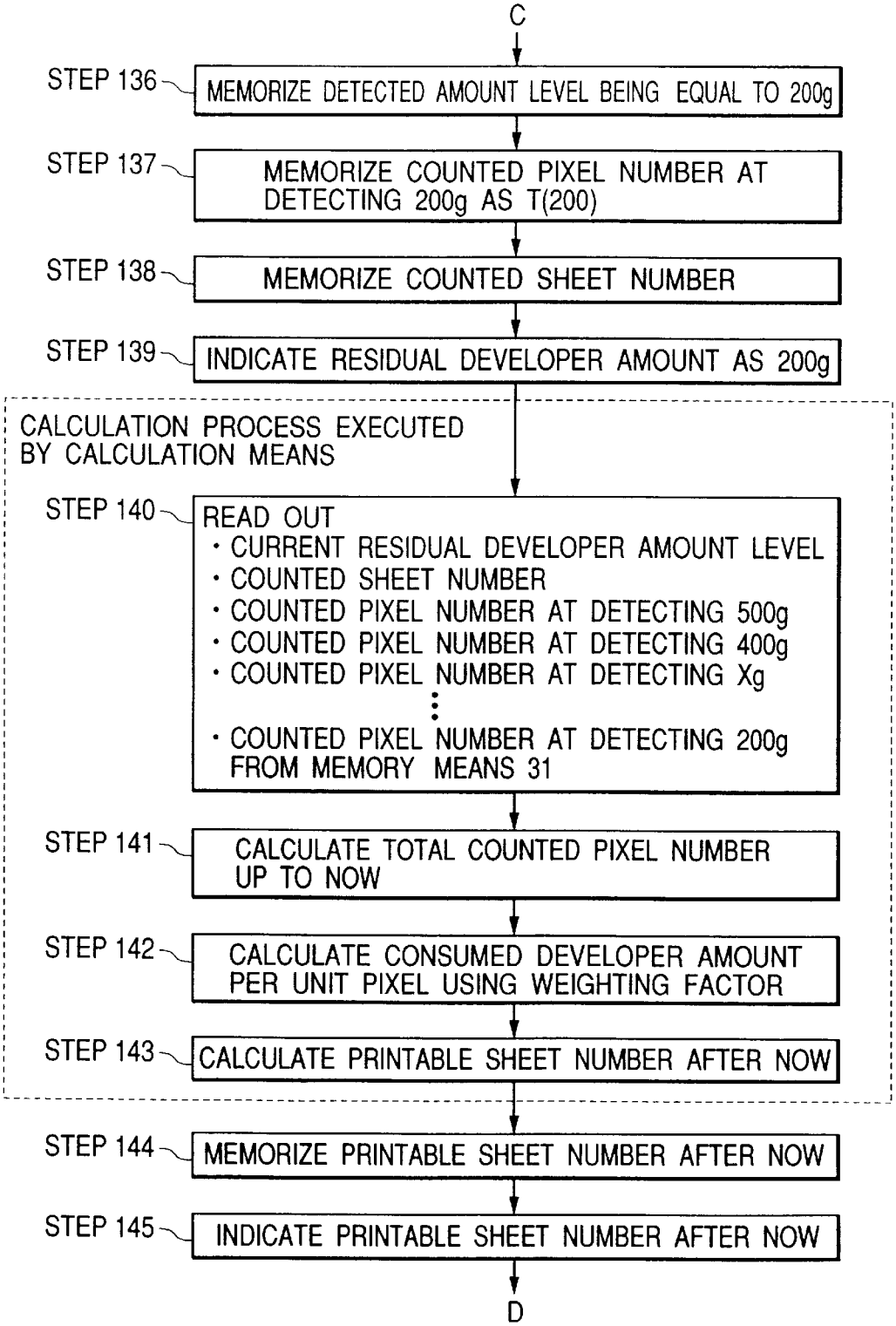
FIG. 13 is a flow chart describing an operation for indicating the printable number of sheets from the present onward in accordance with the present invention.
Figure 14:
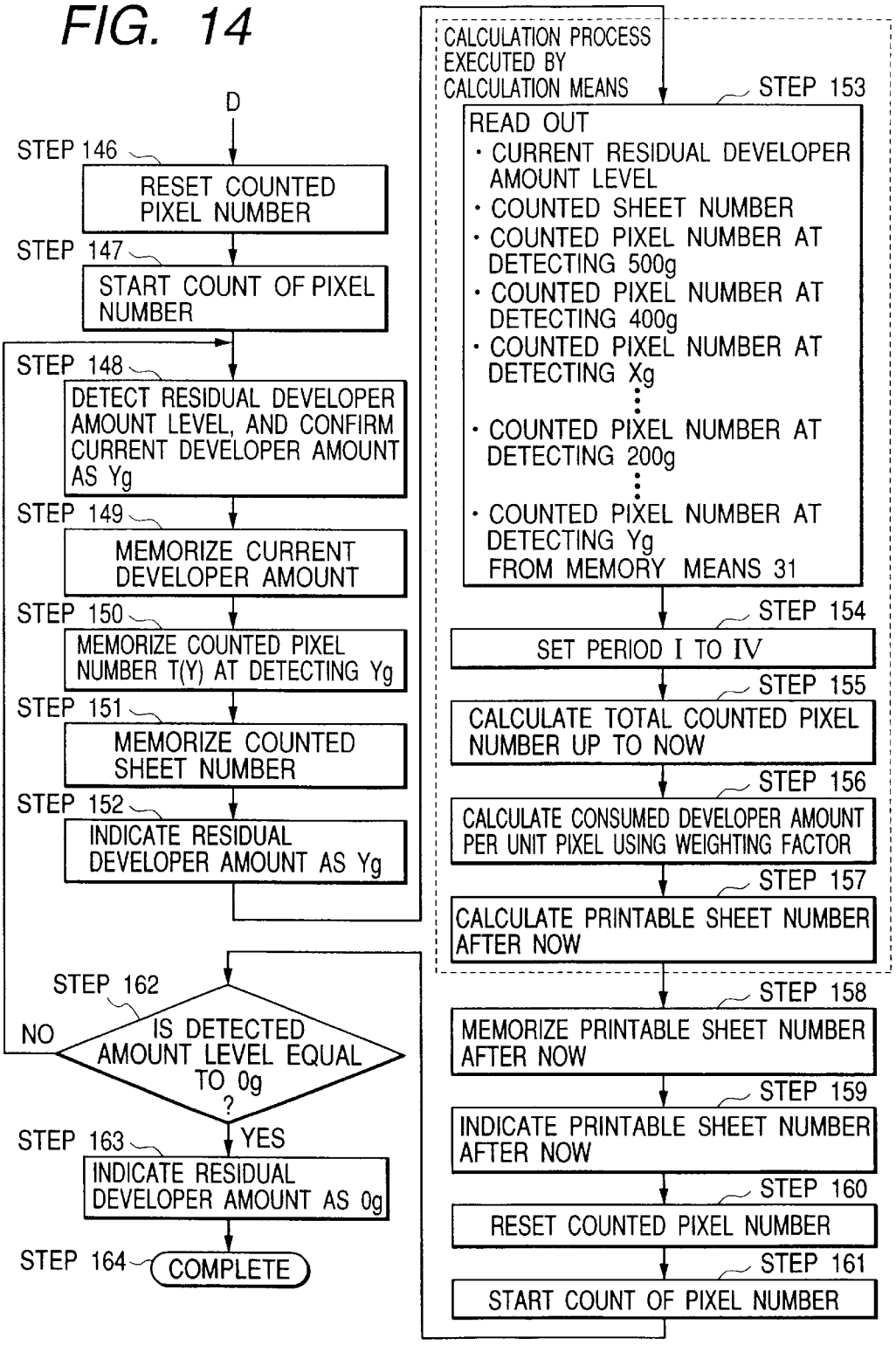
FIG. 14 is a flow chart describing an operation for indicating the printable number of sheets from the present onward in accordance with the present invention.

Step 135: The residual developer amount detecting means 20 determines whether a residual developer amount level was detected as 200 g or not. If NO, the process returns to Step 128 and is repeated. If a residual developer amount was detected as 200 g, the process proceeds to C (FIG. 13).

In this embodiment, X takes a value every 10 g from 390 g to 210 g by the resolution of the residual developer amount detecting means 20. Every time the residual developer amount detecting means 20 confirms the residual developer amount level X g, the total of the number of pixels required for consuming 10 g of toner is memorized in the memory means 31 of the process cartridge and stored by resetting the counter of the number of pixels of the laser light emitting total time detecting means 50.

4. Operation at the time when the residual developer amount level is detected as 200 g.

Step 136: The residual developer amount level of 200 g detected by the residual developer amount detecting means 20 is memorized in the memory means 31 of the process cartridge.

Step 137: The number of pixels up to this time (in this case, the total of the number of pixels from 210 g to 200 g) is memorized in the memory means 31 of the process cartridge, and is further memorized in the storing region and made unrewritable.

Step 138: The count of the number of sheets is memorized in the memory means 31 of the process cartridge.

Step 139: The display means 15 or a display of a personal computer indicates the residual developer amount level memorized in the memory means 31 of the process cartridge.

Steps 140 through 143 are the contents of calculation processing of the calculating means 60.

Step 140: the calculating means 60 reads out the following items from the memory means 31 of the process cartridge:

1) The residual developer amount level up to the present;
2) The number of the recording materials printed up to the present;
3) The number of pixels stored at the time of detecting the residual developer amount level of 500 g;
4) The number of pixels stored at the time of detecting the residual developer amount level of 400 g;
5) The number of pixels stored at the timer of detecting the residual developer amount level of × g (as described above, X takes values every 10 g from 390 g to 210 g); and
6) The number of pixels stored at the time of detecting the residual developer amount level of 200 g Step 141: In order to calculate the sum of the number of pixels up to the present, the number of pixels from the above items 3 to 6 are added.

Step 142: A consumed developer amount per unit pixel is calculated using a predetermined weighting factor.

Step 143: The printable number of sheets from the present onward is calculated by the above-mentioned method.

Step 144: The calculated printable number of sheets from the present onward is memorized in the memory means 31 of the process cartridge.

Step 145: The calculated printable number of sheets from the present onward is indicated by the display means 15 or a display of a personal computer.

5. Operation after a residual developer amount level is detected as 200 g:

Steps 146 through 152: The same as Steps 126 through 134. In this embodiment, Y takes values every 10 g from 190 g to 10 g by the resolution of the residual developer amount detecting means 20. Every time the residual developer amount detecting means 20 confirms the residual developer amount level Y g, the total of the number of pixels required for consuming 10 g of the developer is memorized in the memory means 31 of the process cartridge and stored, by resetting the count of the number of pixels of the laser light emitting total time detecting means 50.

Steps 153 through 157 are the contents of calculation processing of the calculating means 60.

Step 153: The calculating means 60 reads out the following items from the memory means 31 of the process cartridge:

1) The current residual developer amount level;
2) The number of sheets of the recording material printed up to the present;
3) The number of pixels stored at the time of detecting the residual developer amount level of 500 g;
4) The number of pixels stored at the time of detecting the residual developer amount level of 400 g;
5) The number of pixels stored at the time of detecting the residual developer amount level of X g (as described above, X takes values every 10 g from 390 g to 210 g);
6) The number of pixels stored at the time of detecting the residual developer amount level of 200 g; and
7) The number of pixels stored at the time of detecting the residual developer amount level of Y g (as described above, Y takes values every 10 g from 190 g to 10 g).

Step 154: Here, in order to calculate a consumed developer amount per unit pixel using a weighting factor, Period I through Period IV are set as described above in this embodiment.

Period I: $Y$ g to ($Y$+50) g,

Period II: ($Y$+50 g) to ($Y$+100 g),

Period III: ($Y$+100 g) to ($Y$+200 g),

Period IV: ($Y$+200 g) to 500 g,

Period V: 500 g to 1,000 g

That is, Y takes values every 10 g from 190 g to 10 g, and Period I through Period IV are also updated every time Y is confirmed and updated depending on a result of the residual developer amount level detection.

Step 155: In order to calculate the sum of the number of pixels up to the present, the number of pixels of the above 3 through 7 are added.

Step 156: A consumed developer amount per unit pixel are calculated using a predetermined weighting factor.

Step 157: The printable number of sheets from the present onward is calculated by the above-mentioned method.

Step 158: The calculated printable number of sheets from the present onward is memorized in the memory means 31 of the process cartridge.

Step 159: The calculated printable number of sheets from the present onward is indicated by the display means 15 or a display of a personal computer.

Step 160: The count of the number of pixels of the laser light emitting total time detecting means 50 is reset.

Step 161: The laser light emitting total time detecting means 50 resumes the count of the number of pixels required for an image formation.

Step 162: The residual developer amount detecting means 20 determines whether the residual developer amount level was detected as 0% or not. If NO, the process repeats from Step 148.

Step 163: The residual developer amount level indicates 0 g.

Step 164: The process completes.

As described above, in accordance with the present invention, the printable number of sheets from the present onward is calculated by a statistical calculation using a weighting factor that places importance on a consumed developer amount per unit pixel since the residual developer amount in the developer container becomes small with dividing a developer amount into a plurality of periods and making a period shorter as the residual developer amount in the developer container decreases, and how many more sheets of images can be formed until a replacement of a process cartridge and developing means or a supplement of developer to developing means and the like becomes necessary can be calculated accurately.

Further, although this embodiment uses the flat antenna method, being one form of an electrostatic capacitance detecting method, as residual developer amount serial detecting means, the present invention is not limited to the residual developer amount serial detecting means of this method.

The method such as the torque detecting method other than the plate antenna method mentioned in the prior art section hereof can be used as far as a residual developer amount can be detected serially.

(Second Embodiment)

This embodiment is characterized in that the weighting factor described concerning the first embodiment is used not only for estimating a consumed developer amount per unit pixel but also for estimating the number of pixels required for forming one sheet of an image.

A method for calculating the printable number of sheets from the present onward (W) in this embodiment will now be described.

The printable number of sheets from the present onward is estimated from the current residual developer amount based on the estimate of the number of pixels required for forming one sheet of an image and a consumed developer amount per unit pixel. This is represented by the following equation:

The printable number of sheets from the present onward (W)=(The current number of residual developer amount level)/[(Estimate of the number of pixels required for forming one sheet of an image)×(Estimate of a consumed developer amount per unit pixel)]

Using a weighting actor in the estimate of a consumed developer amount per unit pixel is the same as in the first embodiment, and therefore the description thereof is omitted.

(The Number of Pixels Required for Forming One Sheet of an Image)

The number of pixels required for forming one sheet of an image naturally varies depending on the use status of a user such as a text document, a graphic image and the like. Thus, the use status of a user from the present onward is surmised using a weighting factor on the number of pixels to be required for forming one sheet of an image.

(Weighting Factor)

As in the first embodiment, the duration of using the image forming apparatus to date is divided into periods using a residual developer amount level. When the current residual developer amount level is X g, each of Period is represented as follows:

Period I: $X$ g to ($X$+50) g,

Period II: ($X$+50 g) to ($X$+100) g,

Period III: ($X$+100 g) to ($X$+200 g),

Period IV: ($X$+200 g) to 500 g,

Period V: 500 g to 1000 g

These are shown in FIG. 9. The division is not limited to the above of course and is characterized in that a past period closer to the present is getting shorter.

With the decrease in a residual developer amount level, the interval of Period I to Period III and Period V do not change, but only Period IV is extended.

A consumed developer amount per unit pixel is calculated by the following equation:

The number of pixels per one sheet of recording material=(The sum of the number of pixels up to the present)/(The number of sheets of a recording material printed up to the present)(T/sheet)

When the number of pixels in each period is T (period) and the number of sheets of a recording material is P (number of sheets), an average number of pixels per one sheet of a recording material B (period) is represented as follows:

Period I: $B$ (I)=$T$ (I)/$P$ (I),

Period II: $B$ (II)=$T$ (II)/$P$ (II),

Period III: $B$ (III)=$T$ (III)/$P$ (III),

Period IV: $B$ (IV)=$T$ (IV)/$P$ (IV),

Period V: $B$ (V)=$T$ (V)/$P$ (V)

Here, when a weighting factor is as follows:

Period I : $\alpha=0.4$, Period II : $\beta=0.25$, Period III: $\gamma=0.2$, Period IV : $\delta=0.1$, Period V : $\epsilon=0.05$ $(\alpha+\beta+\gamma+\delta+\epsilon=1)$ an average number of pixels per one sheet of a recording material from the present onward is calculated as follows:

$$B=0.4\times B(\mathrm{I})+0.25\times B(\mathrm{II})+0.2\times B(\mathrm{III})+0.1\times B(\mathrm{IV})+0.05\times B(\mathrm{V})$$

In this way, an estimate of an average number of pixels per one sheet of a recording material from the present onward becomes accurate.

As described above, an average number of pixels per one sheet of a recording material from the present onward is calculated by using a weighting factor on an average number of pixels per one sheet of a recording material in the past.

Naturally, values of a weighting factor and divisions of each period are not limited to the above but can be determined properly.

A method for calculating the printable number of sheets from the present onward (W) will now be described.

(The Printable Number of Sheets from the Present Onward (W))

The following values are required for the calculation:

1. The current residual developer amount level (X g)

As described above, this is determined by the residual developer amount detecting means 20.

2. The number of recording materials required for image formation in Period I through Period V(P).

This is an added value by the counter 61 forming the calculating means 60.

In the case of this embodiment, since a calculation of the printable number of sheets from the present onward is started from the residual developer amount of 200 g, a value in Period V and a value between 500 g to 400 g in Period IV are simply added and memorized in the memory means, and a residual value is memorized thereafter for every 10 g as described later.

3. The number of pixels required for an image formation in Period I through Period V (T)

This is a calculated value from the counter 52 of the laser light emitting total time detecting means 50.

In the case of this embodiment, since a calculation of the printable number of sheets from the present onward is started from the residual developer amount of 200 g, a value in Period V and a value between 500 g to 400 g in Period IV are simply added and memorized in the memory means 31, and a residual value is memorized thereafter for every 10 g as described later.

The above values are output from each means and the calculation portion 64 performs the following calculation based on these values:

4. The number of pixels per one recording material=(The number of pixels required for an image formation)/(The number of recording materials)=B=(T/sheet).

In this embodiment, as described above, a correcting factor can be used depending on the size of a recording paper.

5. A consumed developer amount per unit pixel =(A consumed developer amount)/(The number of pixels required for an image formation)=A=(g/T).

In this embodiment, as described above, B is calculated from the following:

$$B=0.4\times B(\mathrm{I})+0.25\times B(\mathrm{II})+0.2\times B(\mathrm{III})+0.1\times B(\mathrm{IV})+0.05\times B(\mathrm{V})$$

6. The printable number of sheets from the present onward (W)=(The current residual developer amount level)/[(The number of pixels per one sheet of a recording material)×(A consumed developer amount per unit pixel)].

In this way, the printable number of sheets from the present onward (W) is calculated by the calculating means 60 and is communicated to a user of by the displaying means 15 or a display of a personal computer.

In the first embodiment, it is described that the number of pixels required for an image formation in each period of Period I through Period V is memorized and stored in the memory means 31 of a process cartridge. The number of sheets of a recording material required for image formation in each period of Period I through Period V is memorized and stored in the storing means 31 of a process cartridge in the same manner.

Therefore, the number of sheets of a recording material required for an image formation is calculated and the printable number of sheets from the present onward can be calculated in the same manner as that of the number of pixels required for image formation of the first embodiment is calculated.

As described, the value of a weighting factor and other values used in this embodiment are not limited to the above.

As described above, in accordance with the present invention, the printable number of sheets from the present onward is calculated by a statistical calculation using a weighting factor that places importance on a consumed developer amount per unit pixel and the number of pixels per one sheet of a recording material since the residual developer amount in the developer container 4 becomes small with dividing a developer amount into a plurality of periods and making a period shorter as the residual developer amount in the developer container 4 decreases, and how many more sheets of images can be formed until the replacement of a cartridge such as a process cartridge or the supplement of developer into a cartridge and the like becomes necessary can be calculated accurately. A correcting factor can be used depending on the size of a recording material.

Further, although this embodiment uses the flat antenna method, being one form of an electrostatic capacitance detecting method, as residual developer amount serial detecting means, the present invention is not limited to the residual developer amount serial detecting means of this method.

The method such as the torque detecting method in addition to the plate antenna method mentioned in the prior art section hereof can be used as far as a residual developer amount can be detected serially.

(Third Embodiment)

The third embodiment is for accurately calculating the printable number of sheets from the present onward simultaneously with increasing the detecting resolution of the residual developer amount detecting means described concerning the first and the second embodiments.

As a residual developer amount detecting resolution in the flat antenna method on this embodiment, considering a limit of measurement resolution, measurement errors and the like, the residual developer amount detecting means 20 can perform a detection operation with the decreasing ratio of 1% when the full developer amount in the developer containing portion in its unused state is assumed to be 100%. In this embodiment, since a virgin process cartridge in which the weight of developer is 1000 g is used, a residual developer amount level can be detected with the decreasing ratio of 10 g.

Further, means for detecting a residual developer amount level by a statistical calculation can be used for the detecting residual developer amount level with a resolution higher than this resolution, for example, with the decreasing rate of 0.1 g.

As described in the first embodiment, a consumed developer amount per unit pixel is calculated by the following equation:

A consumed developer amount per unit pixel=(A consumed developer amount)/(The number of pixels required for an image formation)

Therefore, it is evident that a consumed developer amount is calculated by the following equation:

(A consumed developer amount per unit pixel)×(The number of pixels required for an image formation)=(A consumed developer amount)

That is, as means for detecting a residual developer amount level by a statistical calculation, the laser light emitting total time detecting means 50 being means for detecting the number of pixels required for image formation by a statistical calculation described in the first embodiment may be used.

As in the first embodiment, when the current residual developer amount level reaches X g, the printable number of sheets from the present onward is calculated.

In this embodiment, as in the first embodiment, the consumed developer amount A per unit pixel from the present onward is calculated as follows:

$$A=0.4\times A(\mathrm{I})+0.25\times A(\mathrm{II})+0.2\times A(\mathrm{III})+0.1\times A(\mathrm{IV})+0.05\times A(\mathrm{V})$$

At this time, the calculated consumed developer amount per unit pixel is memorized in the memory means 31 of a process cartridge.

Operation for forming an image is then performed and the number of pixels required for forming an image of one sheet of a recording material is calculated with a statistical method by the laser light emitting total time detecting means 50. A developer amount required for forming an image of one sheet of a recording material is calculated by multiplying the number of pixels by the consumed developer amount per unit pixel memorized in the memory means 31 of the process cartridge.

This calculation is performed by the calculating means 60 for calculating the printable number of sheets from the present onward.

Since the developer amount required for forming an image of one sheet of a recording material is calculated from the number of pixels and is also a calculated value, a resolution can be represented, for example, by 0.1 g.

In this way, by deducting the consumed developer amount calculated with a statistical calculation by the means for detecting a residual developer amount level from the residual developer amount level, being a detection result of the residual developer amount detecting means, a residual developer amount level can be detected with a high resolution and can be communicated to the user. It is also possible to memorize the residual developer amount levels calculated by the two residual developer amount level detecting means in the memory means 31 of the process cartridge.

In this embodiment, as in the first embodiment, since the calculation of the printable number of sheets from the present onward is performed every 10 g that is the resolution of the flat antenna method residual developer amount detection, its operation is the same as in the first embodiment, but it is also possible to calculate the printable number of sheets from the present onward, for example, every 1 g that is a resolution to be attained by using means for detecting a residual developer amount level with a statistical calculation. Since operation in this case is the same as in the first embodiment, the description thereof is omitted.

As described above, by complementing the detection resolution of the residual developer amount detecting means with means for detecting the residual developer amount level by the statistical calculation, the residual developer amount level is detected with high resolution and further the printable number of sheets from the present onward is accurately obtained. Particularly, by means for detecting the number of pixels required for forming an image using the statistical calculation, the residual developer amount level and the number of pixels can be simultaneously detected.

(Fourth Embodiment)

Figure 15:
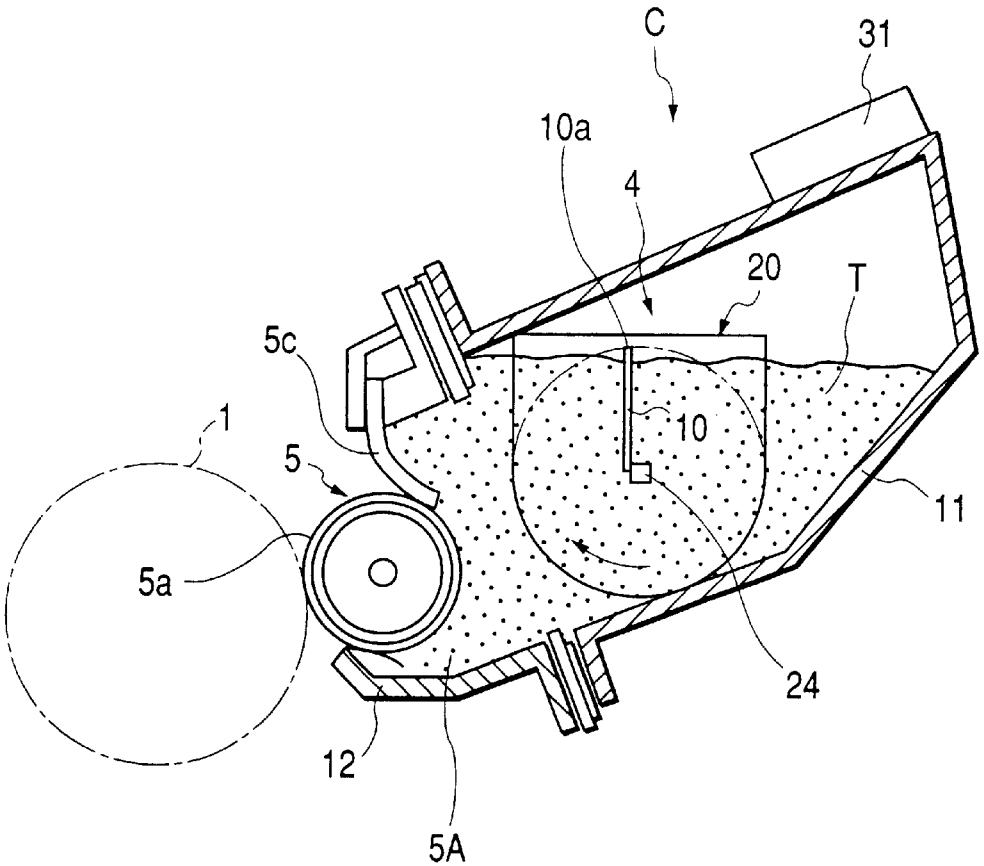
FIG. 15 is a cross sectional view of an embodiment of a developing apparatus constituted as a cartridge of the present invention.

FIG. 15 shows an embodiment of a developing apparatus C which is formed as a cartridge that is another aspect of the present invention.

The developing apparatus C of this embodiment has developer carrying body like a developing roller 5*a* and a developing chamber 5A containing a developer therein in order to supply developer to the developer carrying body, and is integrally formed as a cartridge by developing frame bodies 11, 12 made of plastic. That is, the developing apparatus C of this embodiment is directed to an unit formed by the developing apparatus forming part of the process cartridge B described in the first embodiment, i.e., the developing apparatus C can be regarded as a cartridge that is integrally formed by excluding the photosensitive drum 1, the charging means 2 and the cleaning means 7 from the process cartridge B. Therefore, all the developing apparatus constituting parts and the developer amount detecting means configuration described in the first to the third embodiments are applied to the developing apparatus of this embodiment. Therefore, the above description in the first to the third embodiments are applied to descriptions concerning the configurations and operation.

The same effects as in the first, second and third embodiments may be attained in this embodiment.

What is claimed is:

1. An image forming apparatus comprising:

a developer container for containing a developer;

developer amount detecting means for detecting an amount of the developer contained in said developer container;

a pixel number counter for counting the number of pixels required for forming an image;

a sheet number counter for counting the number of sheets on which the image is formed; and calculating means for calculating a printable number of sheets in accordance with the amount of the developer detected by said developer amount detecting means, an amount of developer required per unit pixel, and a number of pixels required per unit sheet, wherein the amount of developer required per unit pixel is variable.

2. An image forming apparatus according to claim 1, wherein said calculating means calculates a number of pixels required for one sheet of a recording material and a developer amount required per unit pixel based on the developer amount detected by said developer amount detecting means, the number of pixels counted by said pixel number counter and the number of sheets counted by said sheet number counter, and thereafter calculates the printable number of sheets from the present onward.

3. An image forming apparatus according to claim 2, wherein said calculating means estimates a developer amount to be required per unit pixel from the present onward by multiplying the developer amount required per unit pixel in the past by a predetermined weighting factor, and calculates the printable number of sheets from the present onward based on the estimated value of the developer amount to be required per unit pixel from the present onward estimated by said calculation means and the number of pixels required for one sheet of the recording material.

4. An image forming apparatus according to claim 3, wherein said calculating means multiplies a developer amount required per unit pixel in a first past period by a large weighting factor, and multiplies a developer amount required per unit pixel in a second past period by a light weighting factor, wherein the first past period is closer to the present than the second past period, and wherein the large weighting factor is larger than the light weighting factor.

5. An image forming apparatus according to claim 2, wherein said calculating means estimates a developer amount to be required per unit pixel from the present onward by multiplying the developer amount required per unit pixel in the past by a predetermined weighting factor to produce a first estimated value, estimates the number of pixels to be required for one sheet of the recording material from the present onward by multiplying the number of pixels required for one sheet of the recording material in the past by a predetermined weighting factor to produce a second estimated value, and calculates the printable number of sheets from the present onward based on the first and second estimated values.

6. An image forming apparatus according to claim 1, further comprising output means for outputting information regarding the printable number of sheets from the present onward calculated by said calculating means.

7. An image forming apparatus according to claim 6, further comprising display means for displaying the information outputted from said output means.

8. An image forming apparatus according to claim 6, wherein said apparatus is connected to an electronic apparatus having a display, and the information outputted from said output means is indicated on the display.

9. An image forming apparatus according to claim 1, further comprising a memory for storing the developer amount detected by said developer amount detecting means, the number of pixels counted by said pixel number counter, and the number of sheets counted by said sheet number counter.

10. An image forming apparatus according to claim 9, wherein said memory further stores the number of pixels at the time when a detected amount of said developer amount detecting means reaches a predetermined amount, and this number of pixels is information that is not updated.

11. An image forming apparatus according to claim 1, wherein at least said developer container is detachably mountable to said apparatus.

12. An image forming apparatus according to claim 11, further comprising a memory for storing the developer amount detected by said developer amount detecting means, the number of pixels counted by said pixel number counter, and the number of sheets counted by said sheet number counter, wherein said memory forms a unit together with said developer container and said unit is detachably mountable to said apparatus.

13. An image forming apparatus according to claim 12, wherein said unit further comprises at least one of an electrophotosensitive member, charging means for charging said electrophotosensitive member, developing means for supplying the developer to said electrophotosensitive member, and cleaning means for cleaning said electrophotosensitive member.

14. A cartridge detachably mountable on an image forming apparatus, comprising:

a developer container; and a memory for storing data representing a present amount of a developer, an aggregate number of sheets printed by using said cartridge, a first aggregate counted pixel number counted until a time when the amount of developer has reached a first amount, and a second aggregate counted pixel number counted in a period that the amount of developer changes from said first amount to a second amount lower than said first amount.

15. A cartridge according to claim 14, wherein said first and second amounts are information which are not updated.

16. A cartridge according to claim 14, further comprising at least one of an electrophotosensitive member, charging means for charging said electrophotosensitive member, developing means for supplying developer to said electrophotosensitive member, and cleaning means for cleaning said electrophotosensitive member.

17. An image forming apparatus comprising:

a developer container for containing a developer;

developer amount detecting means for detecting an amount of the developer contained in said developer container;

a pixel number counter for counting a number of pixels required for forming an image;

estimating means for estimating an amount of developer required per unit pixel on the basis of the amount of the developer detected by said developer amount detecting means and a pixel count number counted in each used period in which the developer is used by said pixel number counter; and control means for outputting a printable number of sheets from the present onward on the basis of the amount of developer required per unit pixel estimated by said estimating means.

18. An image forming apparatus according to claim 17, further comprising a sheet number counter for counting the number of sheets on which an image is formed, and wherein said control means outputs a number of pixels required for forming an image on one sheet on the basis of the amount of the developer detected by said developer amount detecting means, the number of sheets counted by said sheet number counter, and the number of pixels counted by said pixel number counter, and outputs the printable number of sheets from the present onward on the basis of the number of pixels required for one sheet and the amount of developer required per unit pixel estimated by said estimating means.

19. An image forming apparatus according to claim 18, wherein said estimating means estimates the amount of the developer required per unit pixel from the present onward to produce an estimated result by multiplying the amount of the developer required per unit pixel in the past by a predetermined weighting factor, and said control means outputs the printable number of sheets from present onward on the basis of the number of pixels required for forming an image on one sheet and the estimated result.

20. An image forming apparatus according to claim 18, wherein said estimating means estimates the amount of the developer required per unit pixel from the present onward by multiplying the amount of the developer required per unit pixel in the past by a predetermined weighting factor to produce a first estimated result and estimates the number of pixels required for one sheet by multiplying the number of pixels required for one sheet in the past by the predetermined weighting factor to produce a second estimated result, and said control means outputs the printable number of sheets from the present onward on the basis of the first and second estimated results.

21. An image forming apparatus according to claim 18, wherein said estimating means multiplies the developer amount required per unit pixel in a first used period from a predetermined time by a large weighting factor, and multiplies the developer amount required per unit pixel in a second used period before the predetermined time by a light weighting factor, smaller than said large weighting factor.

22. An image forming apparatus according to claim 18, further comprising a memory for storing the developer amount detected by said developer amount detecting means, the number of pixels counted by said pixel number counter, and the number of sheets counted by said sheet number counter.

23. An image forming apparatus according to claim 22, wherein said memory further stores the number of pixels at the time when the amount of the developer detected by said developer amount detecting means reaches a predetermined amount, and this number of pixels is information that is not updated.

24. An image forming apparatus according to claim 18, wherein at least said developer container is detachably mountable to said apparatus.

25. An image forming apparatus according to claim 24, further comprising a memory for storing the developer amount detected by said developer amount detecting means, the number of pixels counted by said pixel number counter, and the number of sheets counted by said sheet number counter, and wherein said memory forms a unit together with said developer container and said unit is detachably mountable to said apparatus.

26. An image forming apparatus according to claim 25, wherein said unit further comprises at least one of an electrophotosensitive member, charging means for charging said electrophotosensitive member, developing means for supplying the developer to said electrophotosensitive member, and cleaning means for cleaning said electrophotosensitive member.

27. An image forming apparatus according to claim 17, further comprising display means for displaying information concerning the printable number of sheets outputted from said control means.

28. An image forming apparatus according to claim 27, wherein said apparatus is connected to an electronic apparatus having a display, and the information outputted from said control means is indicated on the display.

* * * * *

UNITED STATES PATENT AND TRADEMARK OFFICE

CERTIFICATE OF CORRECTION

PATENT NO. : 6,584,291 B1
DATED : June 24, 2003
INVENTOR(S) : Shinya Yamamoto

It is certified that error appears in the above-identified patent and that said Letters Patent is hereby corrected as shown below:

Column 1,
Line 66, “a” should read -- an --.

Column 4,
Line 4, “sent” should read -- present --.

Column 10,
Line 53, “$\alpha$=0.1,” should read -- $\delta$=0.1, --.

Column 14,
Line 9, “of xg” should read -- of Xg --.

Column 16,
Line 13, “actor” should read -- factor --.

Column 17,
Line 38, “an” should be deleted.

Column 18,
Line 5, “of” should be deleted.

Signed and Sealed this

Third Day of February, 2004

JON W. DUDAS
*Acting Director of the United States Patent and Trademark Office*